US008465032B2

(12) United States Patent
Hill et al.

(10) Patent No.: US 8,465,032 B2
(45) Date of Patent: Jun. 18, 2013

(54) SKATEBOARD DECK

(75) Inventors: Peter Hill, Port Melbourne (AU); Carlo Lunetta, Torrensville (AU); Scott Jensen, Huntington Beach, CA (US); Rodney Mullen, Redondo Beach, CA (US)

(73) Assignee: Chomp, Inc., El Segundo, CA (US)

( * ) Notice: Subject to any disclaimer, the term of this patent is extended or adjusted under 35 U.S.C. 154(b) by 439 days.

(21) Appl. No.: 12/054,282

(22) Filed: Mar. 24, 2008

(65) Prior Publication Data

US 2008/0231009 A1 Sep. 25, 2008

Related U.S. Application Data

(63) Continuation of application No. 11/220,278, filed on Sep. 6, 2005, now Pat. No. 7,347,431.

(60) Provisional application No. 60/609,219, filed on Sep. 9, 2004, provisional application No. 60/612,003, filed on Sep. 10, 2004, provisional application No. 60/662,118, filed on Mar. 16, 2005.

(51) Int. Cl.
*B62M 1/00* (2010.01)

(52) U.S. Cl.
USPC ..... 280/87.042

(58) Field of Classification Search
USPC ..... 280/87.042, 610, 87.01–87.05
See application file for complete search history.

(56) References Cited

U.S. PATENT DOCUMENTS 4,182,520 A 1/1980 Stevenson
4,295,656 A 10/1981 Moore
4,395,263 A 7/1983 Davis
4,806,412 A 2/1989 Wank et al.
4,810,551 A 3/1989 Chu
4,921,513 A 5/1990 Parten
5,165,710 A 11/1992 Runyon
5,271,996 A 12/1993 Tanabe et al.
5,409,265 A 4/1995 Douglas
5,591,509 A 1/1997 Lorenz et al.
5,716,562 A 2/1998 Pearl et al.
5,759,664 A 6/1998 Chisnell et al.

(Continued)

FOREIGN PATENT DOCUMENTS

WO WO 00/29080 5/2000

OTHER PUBLICATIONS

Doughtery, "Time to bail?," *San Diego Union-Tribune*, Apr. 27, 2003.

(Continued)

*Primary Examiner* — Katy M Ebner
(74) *Attorney, Agent, or Firm* — Knobbe, Martens, Olson & Bear LLP

(57) ABSTRACT

According to one disclosed embodiment, a skateboard deck comprises a carbon-fiber shell surrounding a longitudinally-extending interior space. The carbon-fiber shell has an upper inner surface and a lower inner surface opposite the upper inner surface; and a longitudinal beam disposed within the interior space. The longitudinal beam has an upper flange bonded to the upper inner surface of the shell, a lower flange bonded to the lower inner surface of the shell, and a web interconnecting the upper flange and the lower flange. The skateboard deck further comprises a generally rigid exterior portion encasing the core member. The exterior portion comprises at least one layer of wood disposed above or below the shell.

21 Claims, 7 Drawing Sheets

U.S. PATENT DOCUMENTS

| | | | | |
|---|---|---|---|---|
| 5,769,445 | A | 6/1998 | Morrow | |
| 5,863,050 | A | 1/1999 | Meader et al. | |
| 6,059,307 | A * | 5/2000 | Western | 280/609 |
| 6,182,986 | B1 | 2/2001 | Smith | |
| 6,273,440 | B1 * | 8/2001 | Wilson | 280/87.042 |
| 6,386,561 | B1 | 5/2002 | Hanson | |
| 6,460,868 | B2 | 10/2002 | Madrid | |
| 6,520,518 | B2 | 2/2003 | Lo | |
| 6,520,530 | B1 | 2/2003 | Dodge | |
| 6,527,284 | B2 * | 3/2003 | Bert | 280/87.041 |
| 6,648,363 | B2 | 11/2003 | Gordon | |
| 7,044,486 | B2 * | 5/2006 | Wright et al. | 280/87.042 |
| 7,275,755 | B2 | 10/2007 | Marion | |
| 7,347,431 | B2 | 3/2008 | Hill et al. | |
| 7,494,140 | B2 | 2/2009 | Schmitt | |
| 7,506,880 | B2 | 3/2009 | Burwell | |
| 7,669,879 | B2 | 3/2010 | Dykema | |
| 7,735,844 | B2 | 6/2010 | Gallo | |
| 2002/0030338 | A1 | 3/2002 | Bert | |
| 2002/0064640 | A1 | 5/2002 | Renard et al. | |
| 2002/0185835 | A1 | 12/2002 | Wen | |
| 2003/0102650 | A1 | 6/2003 | Gordon | |
| 2003/0127831 | A1 | 7/2003 | Wimbish et al. | |
| 2003/0189314 | A1 | 10/2003 | Quattro et al. | |
| 2003/0222420 | A1 | 12/2003 | Hadzicki et al. | |
| 2004/0003886 | A1 | 1/2004 | Hunter | |
| 2004/0084878 | A1 | 5/2004 | Adamczewski | |
| 2004/0100052 | A1 * | 5/2004 | Chou | 280/87.041 |
| 2004/0135347 | A1 | 7/2004 | Marion | |
| 2004/0183269 | A1 | 9/2004 | Hadzicki et al. | |
| 2004/0188967 | A1 | 9/2004 | Gallo | |
| 2004/0222609 | A1 | 11/2004 | Schmitt | |
| 2005/0115470 | A1 | 6/2005 | Schmitt | |
| 2005/0134013 | A1 | 6/2005 | Wright et al. | |
| 2006/0049596 | A1 | 3/2006 | Hill et al. | |
| 2006/0097469 | A1 | 5/2006 | Nosworthy et al. | |
| 2007/0069492 | A1 | 3/2007 | Lin | |
| 2008/0296858 | A1 | 12/2008 | Burwell | |

OTHER PUBLICATIONS

Haider, "Skateboard Science," *Transworld Skateboarding*, May 14, 2002.

Vuckovich, "Skateboards Diversify," *Transworld Skateboarding*, Feb. 29, 2000.

Wegst et al., "Environmentally-Conscious Materials Selection and Design of Sports Equipment," Proceedings of the 3rd International Sports Engineering Association Conference on The Engineering of Sport, 2000.

"Skateboards Built One at a Time by Skateboarders," www.libskates.com, accessed Aug. 18, 2004.

"Popwar Drops Technical" graphic advertisement, taken from http://getmoneygetcats.blogspot.com/2009/11/p2.html, printed Jun. 1, 2011, having purported posting date of Nov. 25, 2009.

* cited by examiner

SKATEBOARD DECK

RELATED APPLICATIONS

This application is a continuation of U.S. application Ser. No. 11/220,278, filed Sep. 6, 2005, now U.S. Pat. No. 7,347,431, which claims the benefit under 35 U.S.C. §119(e) of U.S. Provisional Application No. 60/609,219, filed Sep. 9, 2004, titled SKATEBOARD DECK CONSTRUCTION, and of U.S. Provisional Application No. 60/612,003, filed Sep. 10, 2004, titled SKATEBOARD DECK CONSTRUCTION, and of U.S. Provisional Application No. 60/662,118 filed Mar. 16, 2005, titled SKATEBOARD DECK CONSTRUCTION. The entire contents of each of the above-mentioned priority patent applications are hereby incorporated by reference herein and made a part of this specification.

BACKGROUND OF THE INVENTION

1. Field of the Invention

Certain embodiments disclosed herein relate to skateboard deck construction.

2. Description of the Related Art

Skateboard decks constructed from laminated wood are well known. However, these and other known skateboard decks suffer from drawbacks in terms of strength, weight, durability, etc.

SUMMARY OF THE INVENTION

According to one embodiment, a skateboard deck comprises a core member comprising a hollow carbon fiber structure, and a generally rigid exterior portion encasing the core member. The exterior portion can optionally comprise a core surround which surrounds a perimeter edge of said core member, and an upper layer overlying said core member. The exterior portion can further optionally comprise a lower layer underlying the core member. The core member can optionally have a skateboard shape. The core member may further optionally comprise a reduced-size skateboard disposed within the exterior portion.

According to another embodiment, a method of making a skateboard deck comprises forming a core member from carbon fiber; imparting a skateboard shape to the core member; and after the imparting, building an exterior portion onto the skateboard-shaped core member. The core member can optionally be hollow. The exterior portion can optionally comprise a core surround and an upper layer. The exterior portion can further optionally comprise a lower layer.

According to another embodiment, a skateboard deck comprises a core member comprising a carbon fiber structure having an internal longitudinal beam, and a generally rigid exterior portion encasing the core member.

According to another embodiment, a core member for a skateboard deck comprises a carbon fiber shell surrounding a longitudinally-extending interior space, and a longitudinal beam disposed within the interior space. The longitudinal beam can optionally be bonded to at least one inner surface of the shell. The longitudinal beam can optionally define a first beam surface bonded to a first inner surface of the shell, and a second beam surface bonded to a second inner surface of the shell.

According to another embodiment, a skateboard deck comprises a carbon-fiber shell surrounding a longitudinally-extending interior space. The carbon-fiber shell has an upper inner surface and a lower inner surface opposite the upper inner surface; and a longitudinal beam disposed within the interior space. The longitudinal beam has an upper flange bonded to the upper inner surface of the shell, a lower flange bonded to the lower inner surface of the shell, and a web interconnecting the upper flange and the lower flange. The skateboard deck further comprises a generally rigid exterior portion encasing the core member. The exterior portion comprises at least one layer of wood disposed above or below the shell.

According to another embodiment, a core member for a skateboard deck comprises a carbon-fiber shell surrounding a longitudinally-extending interior space. The carbon-fiber shell has an upper inner surface and a lower inner surface opposite the upper inner surface. The core member further comprises a longitudinal beam disposed within the interior space. An upper portion of the longitudinal beam is bonded to the upper inner surface of the shell, a lower portion of the longitudinal beam is bonded to the lower inner surface of the shell. The longitudinal beam has a longitudinal cross section with an "S" configuration.

According to another embodiment, a skateboard deck comprises a carbon-fiber shell surrounding a longitudinally-extending interior space. The carbon-fiber shell has an upper inner surface and a lower inner surface opposite the upper inner surface, a longitudinal beam disposed within the interior space, and first and second truck blocks disposed within the interior space. The first and second truck blocks are located at first and second ends of the longitudinal beam. The skateboard deck further comprises a generally rigid exterior portion encasing the core member. The exterior portion comprises at least one layer of wood disposed above or below the shell.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENT

Figure 1:
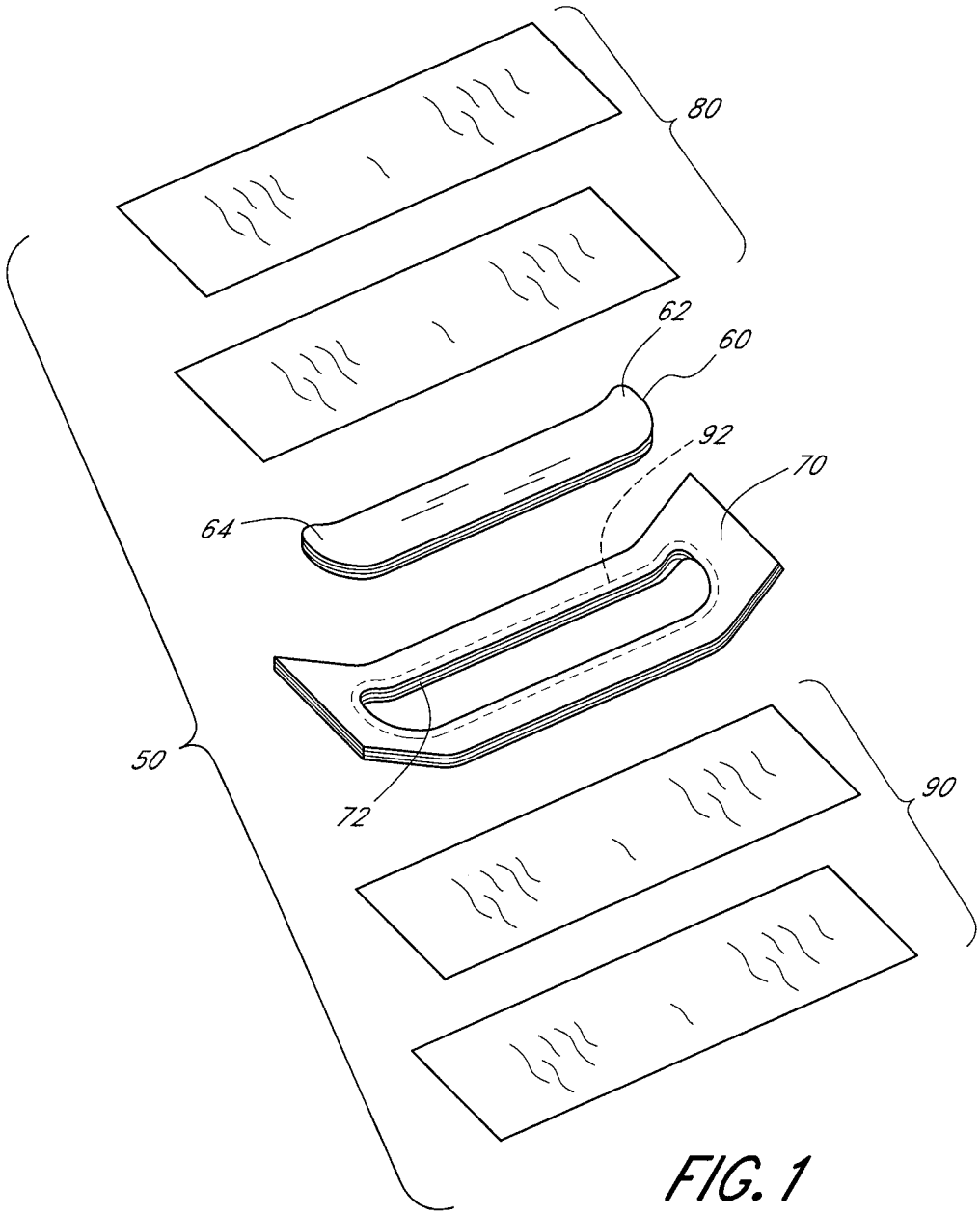
FIG. 1 is an exploded view of the construction of a skateboard deck.

FIG. 1 depicts one embodiment of a skateboard deck 50, which generally comprises a core member 60, a core surround 70 which surrounds the periphery of the core member 60, upper layers 80 which overlie the top of the core member 60 and core surround 70, and lower layers 90 which underlie the bottom of the core member 60 and core surround 70.

In the embodiment depicted in FIG. 1, the core member 60 may have a skateboard shape, i.e. it may comprise a miniature skateboard unto itself. Thus the core member 60 may have upturned front and rear ends 62, 64, a slightly concave upper surface, a slightly convex lower surface, and a planform having a shape approximating an elongated oval. In one embodiment, the core member may comprise a skateboard-shaped member or miniature skateboard deck formed from carbon fiber.

Figure 2:
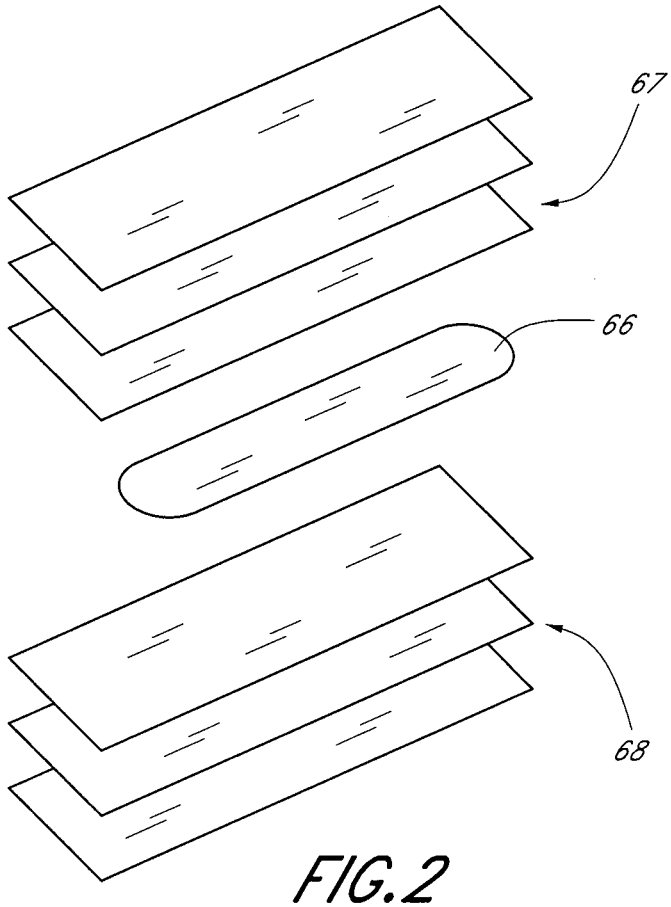
FIG. 2 is an exploded view of the construction of a core member of the skateboard deck of FIG. 1.

The core member 60 may be further configured as shown in FIG. 2, with a foam (e.g., polyester foam) center layer 66 and upper and lower carbon fiber layers 67, 68 which wrap around the center layer 66. The core member 66 may be constructed by wrapping the carbon fiber layers 67, 68 around the center layer 66, with resin and/or other adhesives between the carbon fiber layers 67, 68 (and/or between the carbon fiber layers 67, 68 and the center layer 66), so that the "wrapped" assembly takes on the approximate, elongated-oval planform of the center layer 66. After wrapping, the core member 66 is pressed into the "skateboard" shape described above and depicted in FIG. 1.

Thus, in the embodiment depicted in FIG. 1, the core member 60 comprises a hollow, enclosed multi-layer carbon fiber member with a "skateboard" shape. (The core member 60 is "hollow" in that its center is an empty space or is occupied by a material other than carbon fiber, or by a material which is less dense than carbon fiber.) The core member 60 thus achieves great strength and light weight with a minimum of carbon fiber material, as compared to a simple single layer or layered "sandwich" of multiple carbon fiber layers.

In one embodiment, the carbon fiber layers 67, 68 may comprise three upper and three lower layers, and each of the six layers may be 0.5 mm thick. The resulting core member 60 has a thickness of 0.185 inches.

Figure 3:
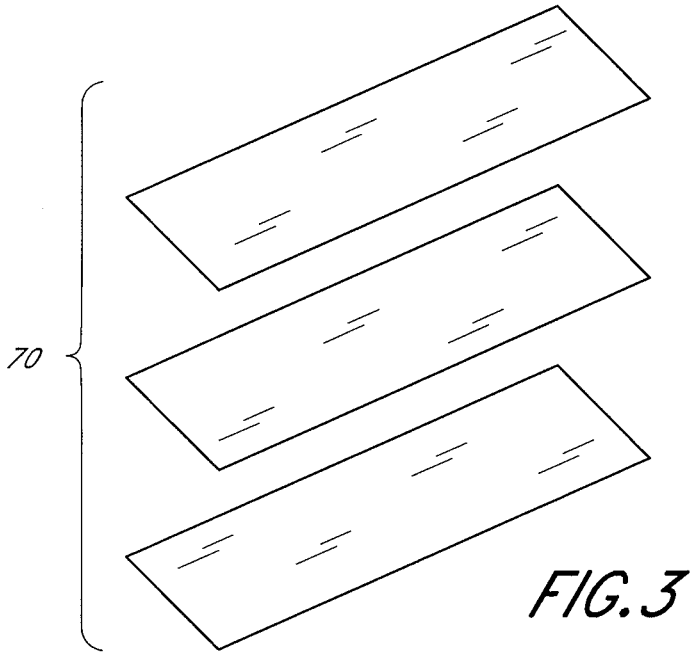
FIG. 3 is an exploded view of the construction of a core surround of the skateboard deck of FIG. 1.

FIG. 3 depicts the construction of the core surround 70 in greater detail. A number (e.g., 3, as depicted) of sheets of wood, fiberglass, plastic, etc. are glued and pressed together to form an enlarged (as compared to the core member 66) skateboard shape within the perimeter of the core surround 70. From within this enlarged skateboard shape is cut out a smaller skateboard shape approximating the size of the core member 66. Thus is formed an inner edge 72 of the core surround 70, which inner edge 72 closely abuts the outer edge of the core member 66 when the core member 66 is placed inside the core surround 70. The core surround 70 thus extends outward from the perimeter of the core member 60, in the completed deck 50.

Upon placement of the core member 60 inside the core surround 70, the upper and lower layers 80, 90 are pressed and bonded together with the core-member-core-surround assembly disposed between them, so that the upper and lower layers 80, 90 conform closely to the contoured shape defined by the core-member-core-surround assembly. The resulting structure is then permitted to cure for an appropriate length of time, and the upper and lower layers 80, 90 and core surround 70 are cut to create a skateboard planform for the overall deck 50. One example of a cut pattern is shown with the dashed lines 92. Any suitable molding and/or lamination processes may be used to join the core member 60, core surround 70 and upper and lower layers 80, 90.

After cutting, the completed deck 50 comprises the core member 66, encased by the core surround 70 and the upper and lower layers 80, 90. Thus the deck 50 comprises a "skateboard within a skateboard" (the skateboard-shaped core member 66 disposed within the layers 80, 90 and the core surround 70). Trucks, wheels, rails, etc. may be added to the deck 50 to create a complete skateboard.

In one embodiment, the core surround 70 may comprise three layers of North American hard maple wood, of 0.062 inches thickness each, to create a core surround 70 of 0.0185 inches thick. In this embodiment the upper and lower layers 80, 90 may also be formed from North American hard maple wood, with the uppermost upper layer 80 and the lowermost lower layer 90 0.062 inches thick, and the balance of the layers 80, 90 0.042 inches thick. The overall thickness of the deck 50 may be about 0.393 inches.

FIGS. 4-7 depict another embodiment of a core member 160, which can be generally similar to the core member 60, except as further described below. As with the core member 60 described above, the core member 160 of FIGS. 4-7 generally comprises a foam center layer 166 surrounded and enclosed by a carbon fiber shell 110. In one embodiment the shell 110 may be formed by wrapping a number of upper and lower layers of carbon fiber material around the center layer 166 and pressing and bonding together the resulting structure, e.g. as shown and described above with regard to the core member 60.

Figure 6:
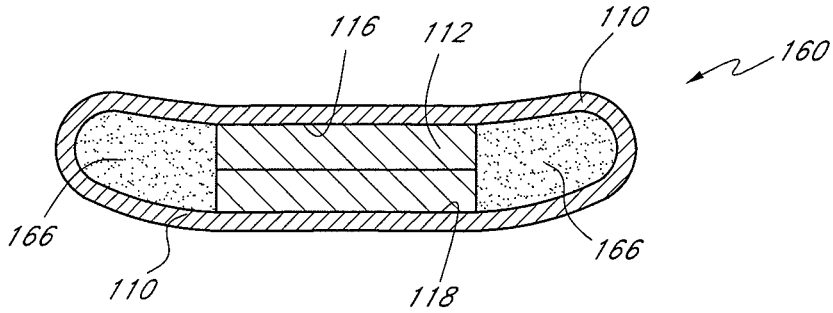
FIG. 6 is a cross sectional view of the core member of FIG. 4, taken along the line 6-6 in FIG. 5.

In the depicted embodiment the core member 160 also includes a pair of hardpoints or truck blocks 112 which reside within the shell 110 and are situated in suitable spaces or openings formed in the center layer 166. The truck blocks are positioned on the longitudinal centerline of the core member 160, and are preferably formed from a rigid and resilient material (e.g. wood, heavy plastic, fiber-reinforced plastic) to receive screws (not shown) that are driven into the deck 50 to hold a pair of trucks to the deck. To accommodate assembly of the center layer 166 around the truck blocks 112, the material of the center layer may be divided into halves by a longitudinal seam 114. As best seen in FIG. 6, in one embodiment the truck blocks may each comprise two stacked layers of wood. Preferably, each of the truck blocks extend from an inner upper surface 116 of the shell 110 to an inner lower surface 118 thereof, so that the blocks abut the shell material at each of the surfaces 116, 118.

Figure 4:
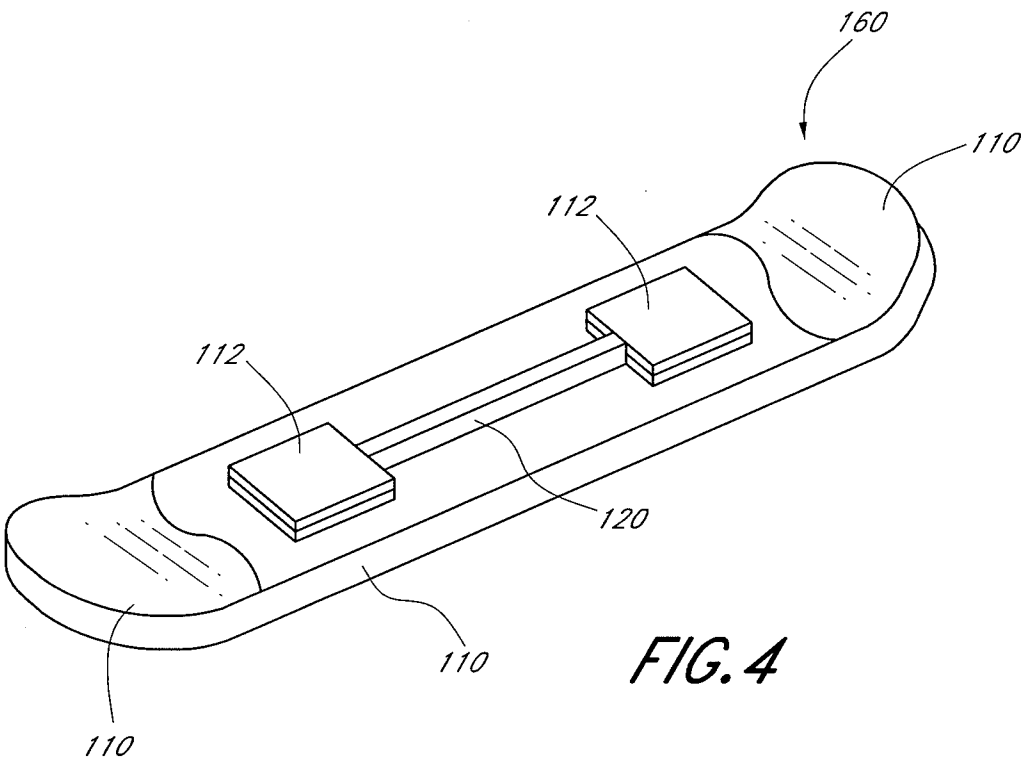
FIG. 4 is a perspective view of another embodiment of a core member suitable for use in the skateboard deck of FIG. 1, with an upper portion of a shell of the core member partially cut away and a center layer of the core member removed for clarity.
Figure 5:
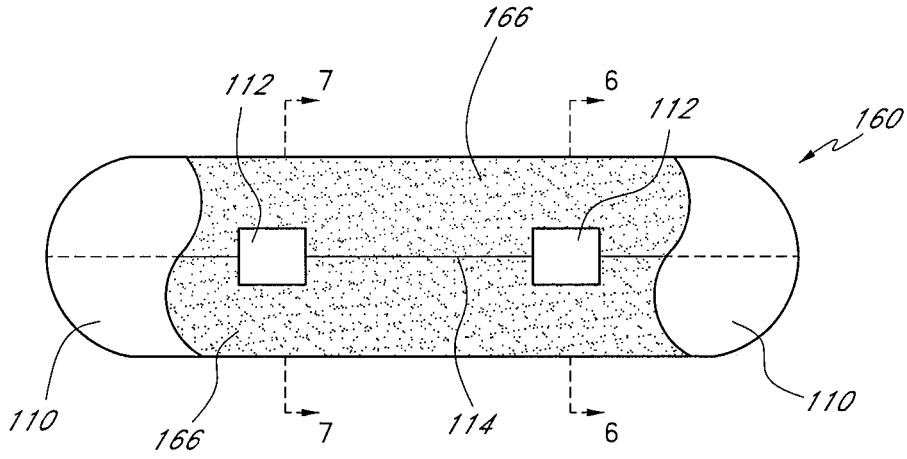
FIG. 5 is a top view of the core member of FIG. 4, with the upper portion of the shell partially cut away for clarity.
Figure 7:
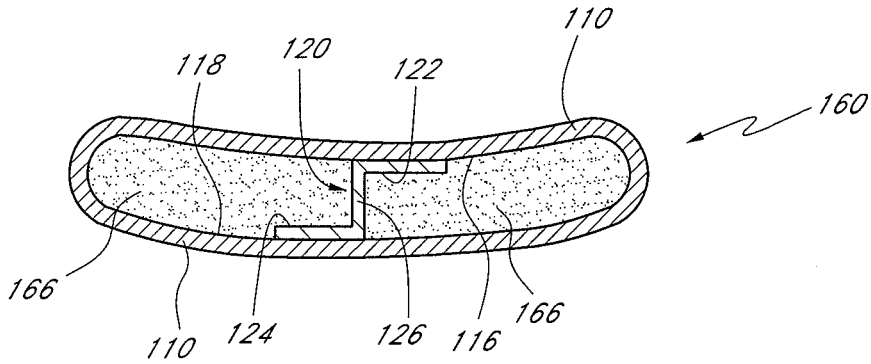
FIG. 7 is a cross sectional view of the core member of FIG. 4, taken along the line 7-7 in FIG. 5.
Figure 8:
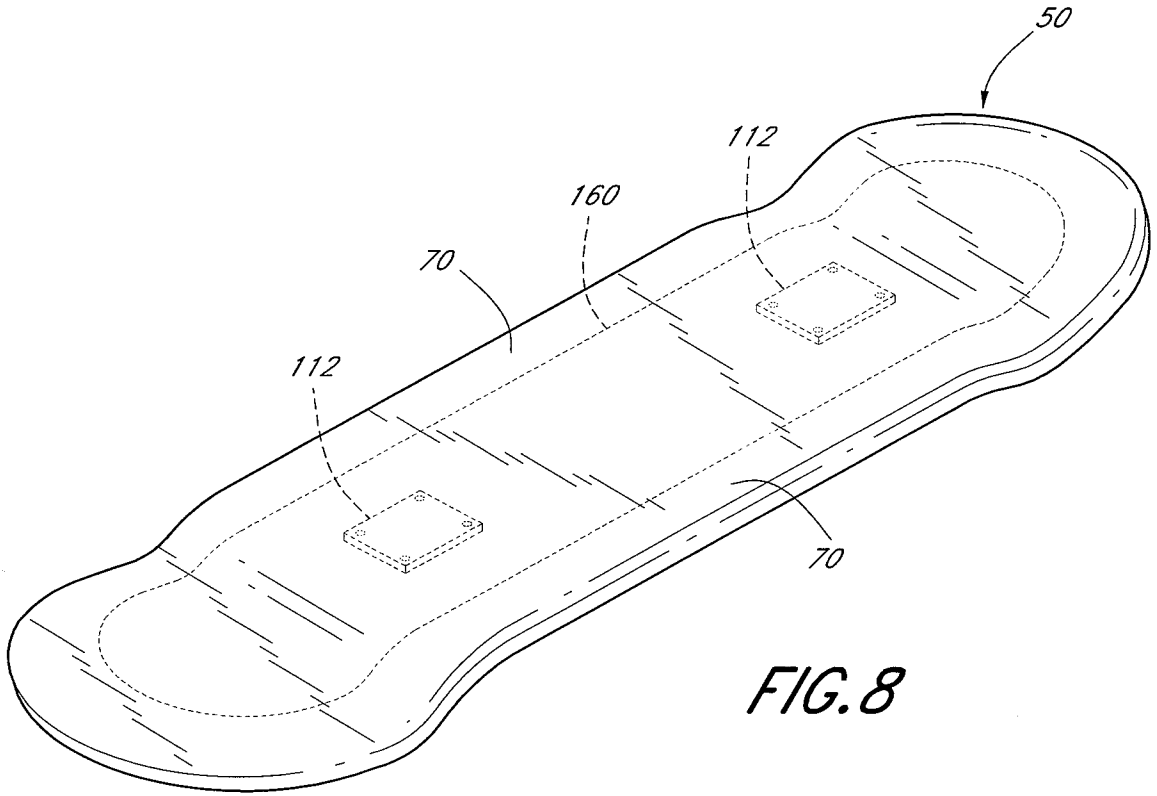
FIG. 8 is a perspective view of a skateboard deck incorporating a version of the core member of FIGS. 4-7.
Figure 9:
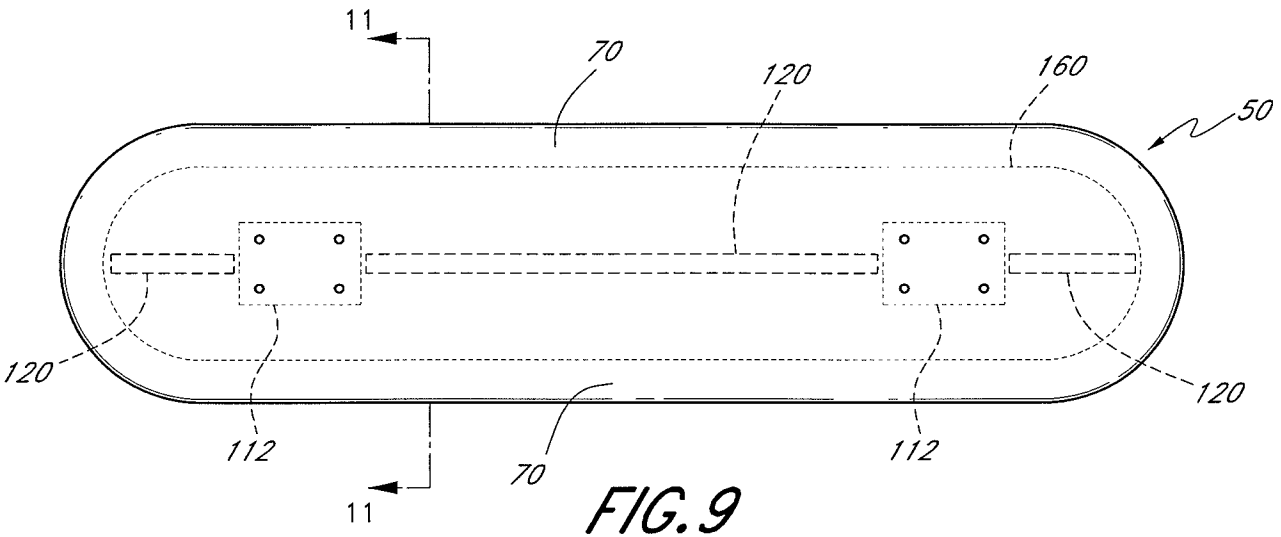
FIG. 9 is a top view of the skateboard deck of FIG. 8.
Figure 10:
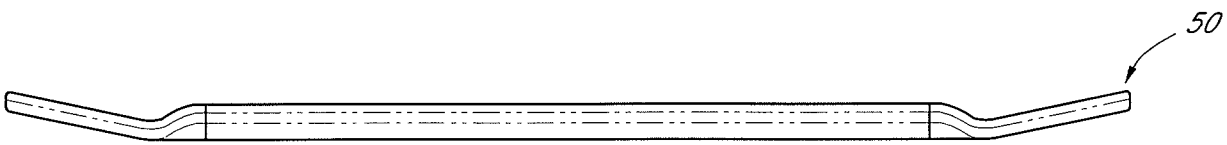
FIG. 10 is a side view of the skateboard deck of FIG. 8.

As best seen in FIGS. 4 and 7, in one embodiment the core member 160 may further comprise a longitudinal beam 120 that extends generally along the longitudinal centerline of the member 160, from one of the truck blocks 112 to the other. (In another embodiment, the longitudinal beam 120 can further extend longitudinally from each truck block 112 to the adjacent end of the core member 160 (see FIG. 9).) The depicted longitudinal beam 120 has an "S" cross section along its entire length, thereby forming upper and lower flanges 122, 124 interconnected by a web 126. In other embodiments, the beam 120 may have a different cross section, such as an, "I," "T," "U," etc., or a box section.

During construction of the core member 160 the upper flange 122 may be securely bonded to the inner upper surface 116 of the shell 110, and the lower flange 124 securely bonded to the inner lower surface 118, to impart great strength and rigidity to the core member.

In one embodiment, the core member 160 may have the following dimensions: overall length of 740 mm; overall width of 140 mm; overall thickness of 4 mm; truck block length of 90 mm; truck block width of 70 mm; and center layer thickness of 3 mm. In this embodiment, the longitudinal distance between the truck blocks is preferably 320 mm.

Further details of the construction of one embodiment of the deck 50 and core member 160 may be seen in FIGS. 8-11B. (The deck 50 and core member 160 of FIGS. 8-11B can be similar to the deck 50 and core members 60, 160 depicted in FIGS. 1-7, except as further described below.) In this embodiment, the center layer 166 of the core member 160 is situated between upper layers 167*a*, 167*b*, 167*c* and lower layers 168*a*, 168*b*, 168*c* (see FIG. 11A). The upper layers 167*a*, 167*b* and the lower layers 168*a*, 168*b* preferably comprise carbon fiber material, and more preferably comprise layers of VTM246 200 gsm unidirectional "prepreg" carbon fiber fabric, trimmed to the profile of the center layer 166 with 10 mm overlap on the edges. The innermost upper layer 167*c* and lower layer 168*c* preferably also comprise carbon fiber material, and more preferably comprise layers of MTM56 200 gsm 2/2 twill prepreg carbon fiber fabric, trimmed to the profile of the center layer 166 with 10 mm overlap on the edges. In addition, the center layer 166 preferably comprises 3 mm thick polyester foam with a density of 80 kg per cubic meter.

In the embodiment of FIGS. 8-11B, the longitudinal beam 120 can have a 3-layer configuration as shown in FIG. 1*l* B, with an inner layer 121*a* situated between two outer layers 121*b*. The inner layer 121*a* preferably comprises carbon fiber material, and more preferably comprises a layer of MTM56 200 gsm 2/2 twill prepreg carbon fiber fabric, trimmed to a width of 40 mm. The outer layers 121*b* preferably comprise carbon fiber material, and more preferably comprise layers of VTM246 200 gsm unidirectional prepreg carbon fiber fabric, trimmed to a width of 40 mm.

Figure 11B:
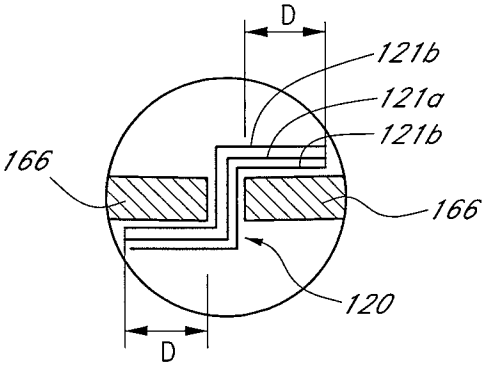
FIG. 11B is a schematic detail view of the indicated portion of FIG. 11, showing the construction of the longitudinal beam and its position in the center layer of the core member.
Figure 11A:
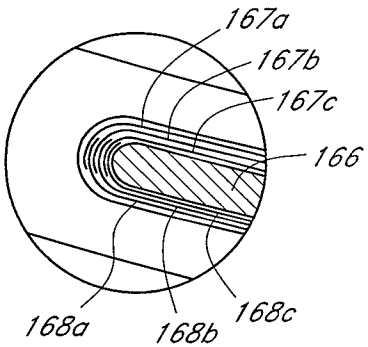
FIG. 11A is a detail view of the indicated portion of FIG. 11.
Figure 11:
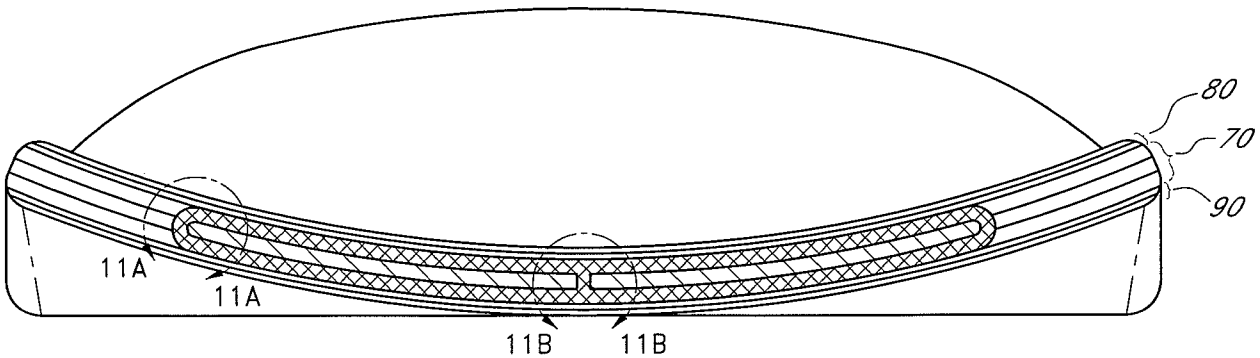
FIG. 11 is a sectional view of the skateboard deck of FIG. 8, taken along the line 11-11 in FIG. 9.

The core member 160 can be constructed by a lay-up process. This process preferably comprises: (a) preparing the truck blocks or hardpoints 112 with appropriately sized (e.g., 90 mm×70 mm) plywood blocks wrapped in adhesive film (e.g., MTM26 resin adhesive film); (b) cutting openings in the material of the center layer 166 to accommodate the truck blocks 112; (c) positioning the longitudinal rib 120 between the two halves of the center layer 166 as shown in FIG. 11B (preferably overlapping the upper and lower faces of the center layer 166 by a distance D of 15 mm); (d) inserting the prepared truck blocks into the openings in the center layer 166; (e) applying the innermost lower layer 168*c* with overlap as shown in FIG. 11A; (f) applying the innermost upper layer 167*c* with overlap over the innermost lower layer 168*c* as shown in FIG. 11A; (g) applying the next lower layer 168*b* with overlap over the underlying layers 167*c*, 168*c* as shown in FIG. 11A; (h) applying the next upper layer 167*b* with the depicted overlap; (i) applying the next lower layer 168*a* with the depicted overlap; and (j) applying the next upper layer 167*a* with the depicted overlap.

After layup, the core member 160 can be placed in a matched-pair mold under vacuum (preferably 1 ATM) and cured at a temperature of 120 C for 15 minutes. After molding and curing, the core member 160 is permitted to cool and is trimmed as necessary for attachment of the upper and lower layers 80, 90 and the core surround 70. The core member 160 may be sanded or otherwise roughened to eliminate any "glossy" spots and improve the adhesion of the core member 160 to the upper and lower layers 80, 90.

Once the completed core member 160 is ready, the upper and lower layers 80, 90 and the core surround 70 can be built onto the core member as discussed above with reference to FIG. 1, to create a complete skateboard deck 50.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular embodiments described above, but should be determined only by a fair reading of the claims that follow.

What is claimed is:

1. A laminated skateboard deck, comprising:

a skateboard body comprising a first end, an opposing second end, and edges extending from the first end to the second end, the edges defining a skateboard planform;

the body comprising a plurality of layers of wood pressed and bonded together, the plurality of layers of wood defining the skateboard body edges and comprising a first outer wood layer, a second outer wood layer, and a plurality of inner wood layers sandwiched between the first and second outer wood layers, the plurality of inner wood layers each having an aperture formed therethrough so that a space is substantially enclosed within the body; and a core member comprising a hollow cured composite material defining an upper wall, a lower wall, and a hollow core member space between the upper and lower walls, the core member having a first mount portion and a second mount portion that are each configured to receive elongate fasteners so as to hold a pair of skateboard trucks to the deck, first and second truck blocks enclosed within the core member space and arranged in the first and second mount portions, respectively, the truck blocks extending from the upper wall to the lower wall of the core member, the core member being elongate so as to extend from the first mount portion to the second mount portion, an edge wall extending between the upper and lower walls at an edge of the core member and about the entire circumference of the core member;

wherein the core member is encased within the skateboard body in the space defined in the skateboard body.

2. A laminated skateboard deck as in claim 1, wherein the hollow core member comprises a foam.

3. A laminated skateboard deck as in claim 1 additionally comprising an elongate longitudinal beam between the first and second mount portions, the beam extending between and connecting the upper and lower walls.

4. A laminated skateboard deck, comprising:

a skateboard body comprising a first end, an opposing second end, and an edge about the periphery of the body, the edge defining a skateboard planform, the body having first and second spaced apart mount zones, each having a plurality of holes through the deck, each hole configured to receive an elongate fastener therethrough so as to hold a first skateboard truck onto the deck at the first mount zone and a second skateboard truck onto the deck at the second mount zone, the body being curved concave upwardly between the mount zones and the edge about the perimeter of the body;

the body comprising a plurality of layers of wood pressed and bonded together, the layers comprising a first outer wood layer, a second outer wood layer, and a plurality of inner wood layers sandwiched between the first and second outer wood layers, each of the layers comprising an outer edge corresponding to the skateboard body edges, and at least some of the plurality of inner wood layers each have an aperture formed therethrough, the layers arranged so that the apertures generally align to define a space substantially enclosed within the body; and an elongate core member comprising an upper wall, an opposing lower wall spaced from the upper wall so that a core member space is defined between the upper and lower walls, a first end, a second end, and an edge wall extending between the upper and lower walls about the periphery of the core member, the upper wall, lower wall and edge wall enclosing a space therebetween, the core member having longitudinally spaced apart first and second mount portions in the first and second mount zones, respectively, first and second truck blocks extending from the upper wall to the lower wall in the first and second mount portions, respectively, and engaging both the upper and lower walls in the respective mount portion, the truck blocks being fully enclosed within the core member space, the core member being concave upwardly between the truck mounts and the edge about the periphery of the core member;

wherein the core member is encased in the space defined in the skateboard body.

5. A laminated skateboard deck as in claim 3, wherein the core member walls comprise a fiber-reinforced composite.

6. A laminated skateboard deck as in claim 3, wherein the core member space is hollow.

7. A laminated skateboard deck as in claim 3, wherein the core member space comprises a material that is less dense that the composite material that makes up the core member walls.

8. A laminated skateboard deck as in claim 7, wherein the core member space comprises a foam.

9. A laminated skateboard deck as in claim 3 additionally comprising a longitudinal beam extending between the upper and lower walls and within the core member space.

10. A laminated skateboard deck as in claim 9, wherein the truck blocks are formed of a different material than is the longitudinal beam.

11. A laminated skateboard deck as in claim 10, wherein the longitudinal beam extends between the first and second truck blocks.

12. A laminated skateboard deck as in claim 11, wherein the longitudinal beam has an "S"-shaped cross section.

13. A laminated skateboard deck as in claim 11, wherein the longitudinal beam additionally extends between the first and second truck blocks and the first and second ends, respectively, of the core member.

14. A laminated skateboard deck as in claim 3, wherein the edge about the periphery of the core member defines a core member planform, and wherein the core member planform and the skateboard planform both have shapes that approximate an elongate oval.

15. A laminated skateboard deck, comprising:

a skateboard body comprising a first end, an opposing second end, and an edge about the periphery of the body, the edge defining a skateboard planform, the body having first and second spaced apart mount zones, each having a plurality of holes extending all the way through the deck, each hole configured to receive an elongate fastener therethrough so as to hold a first skateboard truck onto the deck at the first mount zone and a second skateboard truck onto the deck at the second mount zone, the body being curved concave upwardly between the mount zones and the edge about the perimeter of the body;

the body comprising a plurality of layers of wood pressed and bonded together, each of the layers comprising an outer edge corresponding to the skateboard body edge, and at least one of the wood layers has an aperture formed therethrough, the aperture having an elongated oval shape, the aperture extending from a point between the first end and the first truck mount to a point between the second end and the second truck mount; and an insert formed of a fiber-reinforced composite material and having a peripheral edge, the insert peripheral edge defining an elongate oval shape approximating the elongated oval shape of the aperture, the insert having first and second truck mount portions corresponding to the first and second mount zones, respectively, and having holes formed therethrough, the insert being curved between the mount zones and the insert peripheral edge to correspond to the curvature of the body;

wherein the insert is fit into the body aperture so that the wood of the at least one of the wood layers having the aperture extends between the peripheral edge of the fiber-reinforced composite insert and the edge about the perimeter of the body.

16. A laminated skateboard deck as in claim 6, wherein a first distance is defined between the insert peripheral edge and the body edge at a point along the length of the skateboard deck at the first mount zone, and wherein a distance between the insert peripheral edge and the body edge between the first and second mount zones is no less than the first distance.

17. A laminated skateboard deck as in claim 3, wherein the elongate longitudinal beam divides the core member space into a left space and a right space.

18. A laminated skateboard deck as in claim 4, wherein the truck blocks each comprises a plurality of holes formed therethrough and a aligned with holes extending through the deck, and each hole is configured to accept an elongate fastener therethrough.

19. A laminated skateboard deck as in claim 9, wherein the beam comprises upper and lower flanges interconnected by a web, and wherein the upper flange is attached to the core member upper wall and the lower flange is connected to the core member lower wall.

20. A laminated skateboard deck as in claim 10, wherein the truck blocks comprise wood.

21. A laminated skateboard deck as in claim 13, wherein the longitudinal beam divides the core member space into a left space and a right space.

* * * * *